US008778148B2

(12) United States Patent
Wolf et al.

(10) Patent No.: US 8,778,148 B2
(45) Date of Patent: Jul. 15, 2014

(54) ELECTROLYSIS CELL FOR HYDROGEN CHLORIDE ELECTROLYSIS

(75) Inventors: Aurel Wolf, Wülfrath (DE); Leslaw Mleczko, Dormagen (DE); Volker Michele, Köln (DE); Jens Assmann, Hilden (DE); Jürgen Kintrup, Leverkusen (DE); Rainer Weber, Odenthal (DE)

(73) Assignee: Bayer Intellectual Property GmbH, Monheim (DE)

( * ) Notice: Subject to any disclaimer, the term of this patent is extended or adjusted under 35 U.S.C. 154(b) by 475 days.

(21) Appl. No.: 12/920,202

(22) PCT Filed: Mar. 25, 2009

(86) PCT No.: PCT/EP2009/002163

§ 371 (c)(1),
(2), (4) Date: Aug. 30, 2010

(87) PCT Pub. No.: WO2009/118162

PCT Pub. Date: Oct. 1, 2009

(65) Prior Publication Data

US 2011/0005938 A1 Jan. 13, 2011

(30) Foreign Application Priority Data

Mar. 27, 2008 (DE) ..... 10 2008 015 901

(51) Int. Cl.
*C25B 1/26* (2006.01)
*B82Y 99/00* (2011.01)

(52) U.S. Cl.
USPC ..... 204/252; 204/263; 205/620; 977/749

(58) Field of Classification Search
USPC ..... 205/615–637; 204/252, 263; 977/749
See application file for complete search history.

(56) References Cited

U.S. PATENT DOCUMENTS

| | | | | |
|---|---|---|---|---|
| 6,149,782 | A | 11/2000 | Allen et al. | |
| 7,074,306 | B2 | 7/2006 | Martelli et al. | |
| 2006/0249380 | A1 | 11/2006 | Gestermann et al. | |
| 2007/0275160 | A1 * | 11/2007 | Maldonado et al. | 427/122 |
| 2010/0183950 | A1 * | 7/2010 | Dai | 429/513 |

FOREIGN PATENT DOCUMENTS

| | | | |
|---|---|---|---|
| WO | 2005/035841 | | 4/2005 |
| WO | 2005/063393 | | 7/2005 |
| WO | WO 2007070047 | A2 * | 6/2007 |

* cited by examiner

*Primary Examiner* — Nicholas A Smith
(74) *Attorney, Agent, or Firm* — Norris McLaughlin & Marcus PA

(57) ABSTRACT

Apparatus for hydrogen chloride electrolysis, comprising a cathode that has a layer of nitrogen-doped carbon nanotubes having functional groups containing nitrogen.

17 Claims, 3 Drawing Sheets

ELECTROLYSIS CELL FOR HYDROGEN CHLORIDE ELECTROLYSIS

This is a 371 of PCT/EP2009/002163 filed 25 Mar. 2009 (international filing date), claiming priority of German application 10 2008 015 901.8 filed 27 Mar. 2008.

The invention relates to an apparatus for the electrolysis of hydrogen chloride, which comprises an oxygen-consuming gas diffusion electrode based on nitrogen-doped carbon nanotubes (NCNTs).

BACKGROUND OF THE INVENTION

Considerable quantities of aqueous hydrogen chloride solutions are obtained in the chemical industry. In particular, this is the case in the production of aromatic and aliphatic isocyanates. The recycling of chlorine from the solutions containing hydrogen chloride is usually carried out industrially by electrolysis of hydrogen chloride. To reduce energy costs, oxygen-consuming gas diffusion electrodes, for example, are used on the cathode side.

Such oxygen-consuming gas diffusion electrodes frequently use catalysts in order to reduce the cell potential necessary. These catalysts in many cases comprise noble metals, noble metal salts or noble metal compounds, for instance platinum or rhodium, so that the catalysts are generally very costly.

U.S. Pat. No. 6,149,782 discloses a catalyst comprising rhodium sulphide ($RhS_x$) by means of which oxygen can be reduced. The catalyst is applied to a conductive web, if appropriate together with a binder, and thus forms an electrode which is suitable for the reduction of oxygen on application of an electric potential. Rhodium is a rare and thus expensive material, so that the same economic disadvantages as in the case of those based on other noble metals stand in the way of the use of the electrodes disclosed. A further disadvantage of the electrodes based on rhodium sulphide is their property on the cathode side of the selectivity for the reduction of oxygen decreasing at high current densities and hydrogen being formed as by-product. This limits the industrially achievable current density at which the reduction of oxygen at the electrode can still be operated reliably.

In U.S. Pat. No. 7,074,306 this disadvantage is alleviated by the addition of platinum to the rhodium sulphide. According to the disclosure, the accumulation of hydrogen in the $O_2$ gas stream is prevented in this way even at high current densities. However, such an electrode is at least just as economically disadvantageous as that mentioned above, since the combination of rhodium and platinum further increases the price of the electrode.

U.S. 2006/0249380 discloses further suitable substances which can be employed as catalyst materials in the electrolysis of aqueous hydrogen chloride solutions. Apart from the abovementioned noble metals, rhodium and platinum, iridium, rhenium, ruthenium and palladium, their sulphides and oxides and also mixed phases, in particular with molybdenum and/or selenium, are disclosed as possible catalytically active materials. A material combination whose catalytic effect is not based on noble or transition metals is not disclosed.

The use of such noble metal catalysts also has the disadvantage that contact of the catalyst with chlorine and/or hydrochloric acid on the cathode side, too, cannot be reliably prevented during operation of electrodes in the electrolysis of hydrogen chloride and the materials mentioned react with chlorine and/or hydrochloric acid to form salts which can be leached from the electrode material. The performance of the electrodes can thus deteriorate as the period of operation increases and the life of the electrodes is limited due to consumption of catalyst material.

WO 2005/035841 discloses a process for producing nitrogen-doped carbon nanotubes on a conductive surface, in which the nitrogen-doped carbon nanotubes are deposited directly from a gas phase. This results in electrodes which can be used for the reduction of oxygen in batteries or fuel cells. The nitrogen-doped carbon nanotubes disclosed overcome the need to use expensive noble or transition metals as catalysts.

Only a limited variation in the layer thickness of the deposited material can be achieved in the direct deposition of the nitrogen-doped carbon nanotubes on the surface of the conductive material. A low layer thickness of the deposited nitrogen-doped carbon nanotubes has to be expected. In the electrolysis of hydrogen chloride, it is generally known to those skilled in the art that some leakage of the chlorine through the membrane from the anode side to the cathode side can frequently not be prevented. This chlorine is generally reduced again to chloride on the cathode side. Electrocatalytically active layers which are too thin, as are obtained according to the disclosure of WO 2005/035841, are disadvantageous for use in this technical field because corrosive attack on the material located under the catalytic layer has to be reckoned with. Furthermore, it is not possible to provide a sufficient number of active sites for the desired reaction in a thin catalyst layer, so that industrially feasible operation at high current density is not possible. Furthermore, WO 2005/035841 does not disclose any suitable arrangement together with a counterelectrode (anode) which would be able to be used in the electrolysis of hydrogen chloride.

It is therefore an object of the invention to provide an apparatus for the electrolysis of hydrogen chloride, which comprises an oxygen-consuming gas diffusion electrode which largely or completely dispenses with the use of expensive noble and/or transition metals and comprises catalytic materials which are not consumed or deactivated during operation and also has an increased selectivity for the reduction of oxygen at the electrode compared to known materials.

SUMMARY OF THE INVENTION

It has surprisingly been found that an apparatus for the electrolysis of hydrogen chloride which is characterized in that it comprises an electrode chamber (A) having an electrode (1) having a core (1*a*) on which a layer (1*b*) comprising at least a proportion of nitrogen-doped carbon nanotubes (NCNTs) has been applied and a further electrode chamber (B) having an electrode (2), with electrode chamber (A) and electrode chamber (B) being separated by a membrane (M) and the electrodes (1 and 2) being electrically conductively connected to one another via a power supply (S), can achieve this object.

The invention provides, in particular, an apparatus for the electrolysis of hydrogen chloride gas or solutions containing hydrogen chloride, in particular for the electrolysis of hydrochloric acid having an HCl concentration in the range from 10 to 25% by weight, having an electrode chamber A having a cathode (1) and a further electrode chamber (B) having an anode (2), with electrode chamber (A) and electrode chamber (B) being separated by an ion-conducting membrane (M) and the electrodes being electrically conductively connected to a power supply (S), characterized in that the cathode (1) has an electrically conductive core (1*a*) on which a layer (1*b*) comprising at least a proportion of nitrogen-doped carbon nanotubes and, if appropriate, a further layer (1*c*) between core (1*a*) and layer (1*b*) has been applied, with the nitrogen-doped carbon nanotubes having functional groups containing nitrogen.

DETAILED DESCRIPTION

The carbon nanotubes having functional groups containing nitrogen which are used according to the invention will also be referred to as nitrogen-doped carbon nanotubes for short.

A preferred embodiment of the apparatus is characterized in that electrode chamber (A) (cathode chamber) is provided with a feed line (3) for an aqueous electrolyte solution containing oxygen gas or for air or oxygen-containing gases.

The electrode chamber (B) is preferably provided with a feed line (4) for hydrochloric acid or gas containing hydrogen chloride.

A particularly preferred embodiment of the apparatus is characterized in that the nitrogen-doped carbon nanotubes have been produced by the following process:

a. precipitation of at least one metal (M) from a solution of a metal salt (MS) of the at least one metal (M) in a solvent (L) to give a solids suspension (S) containing metals (M),
b. separation of the solid (F) from the suspension (S) and if appropriate after-treatment of the solid (F) to give a metal catalyst (K),
c. introduction of the metal catalyst (K) into a fluidized bed,
d. reaction of at least one nitrogen-containing carbon compound as starting material (E1), or of at least two starting materials (E2, E2'), where at least one starting material comprises a carbon compound and at least one starting material comprises a nitrogen compound, in the fluidized bed over the metal catalyst (K) at elevated temperature, in particular at least 300° C., in the presence of hydrogen gas or hydrogen-containing compounds to form nitrogen-doped carbon nanotubes (NCNTs),
e. discharge of the nitrogen-doped carbon nanotubes (NCNTs) from the fluidized bed.

Such a process has also been described in the hitherto unpublished German patent application number DE 10 2007 062 421.4.

The catalyst for the production of the nitrogen-doped carbon nanotubes is based on manganese, cobalt, $Al_2O_3$ and MgO, where Mn is present in a proportion by mass of from 2 to 65% and Co is present in a proportion by mass of from 2 to 80%, $Al_2O_3$ is present in a proportion by mass of from 5 to 75% and MgO is present in a proportion by mass of from 5 to 70%.

A preferred embodiment of the apparatus is characterized in that the cathode (1) is electrically connected to a current distributor made up of one or more materials selected from the list consisting of copper, graphite, titanium, titanium alloy containing noble metal, in particular TiPd, and the Ni alloys Hastelloy and Incolloy.

In a particularly preferred embodiment of the apparatus, the layer (1*b*) comprises a binder, in particular a binder based on fluorine-containing polymers, preferably PTFE.

Very particular preference is given to an apparatus which is characterized in that the layer (1*b*) comprises a proportion of at least 10% by weight of nitrogen-doped carbon nanotubes, preferably at least 20% by weight, particularly preferably at least 40% by weight, very particularly preferably at least 60% by weight.

The nitrogen-doped carbon nanotubes preferably contain a proportion of nitrogen of at least 1% by weight, preferably at least 3% by weight, particularly preferably at least 5% by weight.

The thickness of the layer (1*b*) is preferably not more than 200 μm, preferably from 1 μm to 150 μm, particularly preferably from 10 μm to 100 μm.

The ion-conducting membrane (M) is preferably a polymer membrane, particularly preferably a polymer membrane based on polymeric perfluorosulphonic acids.

In a particular variant of the apparatus, the ion-conducting membrane (M) and the layer (1*b*) of the cathode (1) are in direct contact.

In another particular variant of the apparatus, a gas diffusion layer (1*c*) is present as further layer between core (1*a*) and layer (1*b*), with the further layer (1*c*) particularly preferably comprising at least one electrically conductive material, in particular graphite, and a hydrophobic material, in particular PTFE.

The invention also provides a process for the electrolysis of hydrogen chloride carried out in an apparatus according to the invention.

Electrode chamber (A) can be filled with an electrolyte solution comprising dissolved oxygen or with gas. Electrode chamber (A) is preferably filled with an oxygen-containing gas. Particular preference is given to feeding pure oxygen or oxygen/air mixtures into the electrode chamber (A).

An electrolyte solution comprising hydrogen chloride or a gas comprising hydrogen chloride is usually present in electrode chamber (B).

In the context of the present invention, electrolyte solutions are all solutions whose solvent is water and which comprise at least further ions other than $H^+$, $H_3O^+$ and $OH^-$. These are characterized by a higher specific conductivity than that of pure water. Nonlimiting examples are aqueous solutions of NaCl, $MgCl_2$, and also acids which are soluble in water or are miscible therewith, e.g. $H_2SO_4$, HCl, etc.

The core according to the invention (1*a*) of the cathode (1) is usually used in the form of a rod, a plate, a gauze, a mesh, a nonwoven fabric or a woven fabric.

If the core (1*a*) of the cathode (1) is used in the form of a rod or a plate, the core (1*a*) can be porous or nonporous.

The core (1*a*) of the cathode (1) preferably has the form of a gauze, mesh, nonwoven fabric or woven fabric.

The core according to the invention (1*a*) of the cathode (1) is usually composed of an electrically conductive material which is preferably chemically stable towards the electrolyte solutions comprising hydrogen chloride.

In the context of the present invention, the term chemically stable refers to a material which does not undergo any chemical reaction with the electrolyte solutions comprising hydrogen chloride which surround it under the operating conditions of the apparatus.

Preferred electrically conductive, chemically stable materials are carbon black, graphite or coated metals. As metals, it is possible to use, for example, titanium or titanium alloys or the special metal alloys which are generally known to those skilled in the art under the names Hastelloy and Incolloy.

Particularly preferred materials for the core (1*a*) of the cathode (1) are materials selected from the list graphite, titanium, titanium alloy and the special metal alloys Hastelloy and Incolloy.

In a preferred further development of the invention, the core (1*a*) of the cathode (1) can also be a coated core (1*a'*). Possible coated cores (1*a'*) comprise the above-described core (1*a*) and a coating of a conductive transition metal oxide or transition metal mixed oxide comprising transition metals having atomic numbers from 21 to 30 and/or transition metals having atomic numbers from 39 to 48 and/or transition metals having atomic numbers 57 to 80. Iridium and/or ruthenium and/or titanium are preferred among the transition metals.

The layer according to the invention (1*b*) usually has a thickness in the range from 10 μm to 3 mm. The layer (1*b*) preferably has a thickness in the range from 30 μm to 1 mm.

The layer according to the invention (1*b*) can comprise not only the proportion of nitrogen-doped carbon nanotubes (NCNTs) but also a proportion of binder and, if appropriate, a proportion of at least one metal. The layer (1*b*) preferably additionally comprises a proportion of binder.

The binder can be hydrophilic or hydrophobic and is usually chemically stable. The binder is usually a polymer, for example a perfluorinated polymer such as polytetrafluoroethylene.

Preference is given to using proton-conducting polymers such as polymeric perfluorosulfonic acids, for example the polymer Nafion marketed by DuPont.

The nitrogen-doped carbon nanotubes (NCNTs) can be present in the layer either as such or on a support. If the nitrogen-doped carbon nanotubes (NCNTs) are to be used on supports, preference is given to supports having a higher specific surface area, for example finely divided graphite, activated carbon, carbon black, etc.

The proportion of nitrogen-doped carbon nanotubes (NCNTs) in the layer (1*b*) of the cathode (1) is usually at least 20% by weight. Preference is given to a proportion of at least 40% by weight, particularly preferably at least 50% by weight.

Nitrogen-doped carbon nanotubes according to the invention are usually carbon nanotubes which comprise a proportion of at least 1% by weight of nitrogen. The nitrogen-doped carbon nanotubes preferably comprise at least 3% by weight of nitrogen, particularly preferably at least 5% by weight of nitrogen.

A low proportion of nitrogen leads to the electrode potential becoming greater, so that more electric power is required for operation of the apparatus. More power is in turn economically disadvantageous.

If the layer (1*b*) comprises a proportion of at least one metal, the metal is usually one of the metals selected from the list rhodium, platinum, iridium, rhenium, ruthenium and palladium, their sulphides and oxides and also mixed phases, in particular with molybdenum and/or selenium. Preference is given to a compound of ruthenium and selenium, particularly preferably rhodium sulphide (Rh17S15).

The anode (2) according to the invention can comprise titanium or titanium alloys, for example titanium-palladium, and can be coated. If the anode (2) is coated, it is preferably coated with a mixed oxide comprising one or more of the metals ruthenium, iridium and titanium. Particular preference is given to a coating comprising a mixed oxide of ruthenium oxide and titanium oxide or a mixture of ruthenium oxide, iridium oxide and titanium oxide.

The anode (2) according to the invention can also comprise graphite and other carbon materials such as diamond. Preference is given to graphite electrodes, nitrogen-free and nitrogen-doped carbon nanotubes, boron-doped diamond and particularly preferably the abovementioned materials after oxidation, for example in nitric acid, or after activation in alkaline solution at temperatures above 30° C.

The anode (2) according to the invention is usually used in the form of a rod, a plate or a gauze or mesh. If the anode (2) is used in the form of a rod or a plate, the anode (2) can be porous or nonporous. Preference is given to anodes (2) in the form of a gauze or mesh. Particular preference is given to porous graphite electrodes.

The ion-conducting membrane (M) according to the invention usually comprises a polymer membrane. Preferred polymer membranes are all polymer membranes which are generally known to those skilled in the art under the collective term cation-exchange membrane. Preferred membranes comprise polymeric perfluorosulfonic acids. The membranes (M) can also comprise reinforcing woven fabrics of other chemically stable materials, preferably fluorinated polymers and particularly preferably polytetrafluoroethylene.

The thickness of the ion-conducting membrane (M) is usually less than 1 mm. The thickness of the membrane (M) is preferably less than 500 μm, particularly preferably less than 400 μm, very particularly preferably less than 250 μm.

The low thicknesses of the ion-conducting membrane are particularly advantageous because the necessary cell potential in the apparatus can as a result be made smaller since the electrical resistance is reduced. A decrease in the membrane thickness is usually associated with an increase in the leakage of chlorine through the ion-conducting membrane, as a result of which the cathode (1) located behind the ion-conducting membrane is exposed to chlorine. This could lead to corrosion of the cathode. However, since the apparatus of the invention comprises a layer (1*b*) comprising NCNTs which are chemically stable to chlorine, a leakage of chlorine can be tolerated at a relatively low cell potential.

The power supply (S) is usually operated so that cathode (1) forms the cathode and anode (2) forms the anode.

As a result, chlorine is formed in the electrode chamber (B) while oxygen is reduced to water in the electrode chamber (A).

In a preferred further development of the apparatus of the invention, the ion-conducting membrane (M) is applied directly to the layer comprising the nitrogen-doped carbon nanotubes (1*b*) of the cathode (1).

This further development is particularly advantageous because an integrated cathode which significantly decreases the path for proton transport can be produced as a result. The conversion at the cathode is therefore particularly efficient.

In a particularly preferred further development of the present invention, a further layer (1*c*) is introduced between the layer comprising the nitrogen-doped carbon nanotubes (1*b*) and the core (1*a*) of the cathode (1) and the ion-conducting membrane (M) is applied directly to the layer comprising the nitrogen-doped carbon nanotubes (1*b*).

According to this particularly preferred further development, the further layer (1*c*) usually comprises a gauze or woven fabric and/or a filler material. The gauze or woven fabric is usually made of a material which is chemically stable according to the above definition. Preference is given to a woven fabric composed of carbon, particularly preferably graphitic carbon. The filler material usually comprises a binder as is also used in the layer according to the invention (1*b*) and, if appropriate, carbon nanotubes. The filler preferably comprises a binder as is also used in the layer according to the invention (1*b*) and carbon nanotubes. Particularly preferred carbon nanotubes in the further layer (1*c*) are nitrogen-doped carbon nanotubes (NCNTs).

The gas diffusion electrodes according to the invention (also referred to as oxygen-consuming cathodes) are characterized by low materials costs and high selectivity (no formation of hydrogen at high current densities). In addition, possible problems caused by dissolution of noble metals or noble metal compounds by the corrosive medium (hydrogen chloride and/or chlorine) do not occur.

The electrochemical cell of the invention comprising nitrogen-doped carbon nanotubes (NCNTs) can be used for the electrolysis of hydrogen chloride.

When used in the electrolysis of hydrogen chloride, the apparatus is usually operated using aqueous hydrogen chloride solution having a concentration of from 0.5 mol/l to 10 mol/l, preferably from 3 mol/l to 6 mol/l. Operation is carried out at a temperature of 0-200° C., preferably 20-120° C. and very preferably 40-90° C. However, the electrolysis of hydrogen chloride can also be carried out in the gas phase, i.e. hydrogen chloride is fed in the gaseous state with or without water.

The apparatus of the invention and processes in this apparatus are illustrated below by means of figures and examples, but without the figures and examples constituting a restriction of the inventive concept.

BRIEF DESCRIPTION OF THE DRAWINGS

FIG. 3) using nitrogen-doped carbon nanotubes in various loadings (14.7 and 9.8 g of NCNT per $m^2$ of cathode area) in the completely noble metal-free layer 1*b*.

The electrode chamber (A) containing the cathode (1) is supplied via a feed line (3) with oxygen ($O_2$) which can be purified or saturated with water via a gas absorption apparatus ($G_o$).

The electrode chamber (A) is likewise provided with a discharge line (3') for the product of the electrochemical reduction of oxygen at the cathode (1) and for excess water which is fed in the form of a gas/liquid mixture comprising water (vapour) and oxygen and also possibly hydrogen to a condenser (K). To monitor any hydrogen formed, a hydrogen measurement device ($C_H$) is installed in a safety outlet for such hydrogen ($H_2$) above the condenser (K), and this hydrogen measurement device ($C_H$) is monitored during the experiments and the current and/or the voltage of the power supply (S) can be adjusted as a function of the measured value indicated. A liquid comprising water ($H_2O$) is taken off from the condenser.

The electrode chamber (B) containing the anode (2) is supplied via a feed line (4) through a heating apparatus (H) with hydrochloric acid which comes either from a reservoir (HCl) by means of a metering pump ($P_2$) and/or via a recycle stream (4*a*) which is produced by branching of a substream from the discharge line (4') of the electrode chamber (B) by means of a circulating pump ($P_1$). The recycle stream (4*a*) can additionally be adjusted via a bypass stream (4*a*') by appropriately setting an adjustment valve (V). A further substream (4*b*) comprising essentially chlorine and possibly hydrogen chloride is obtained at the abovementioned branching point and is fed to a gas absorption unit (G) containing a first and a second gas absorption apparatus ($G_1$, $G_2$). Gaseous chlorine ($Cl_2$) and a low-concentration hydrochloric acid in water (HCl') are taken off from the second gas absorption apparatus ($G_2$) of the gas absorption unit (G).

EXAMPLES

Example 1

Electrochemical Cell According to the Invention

Figure 1:
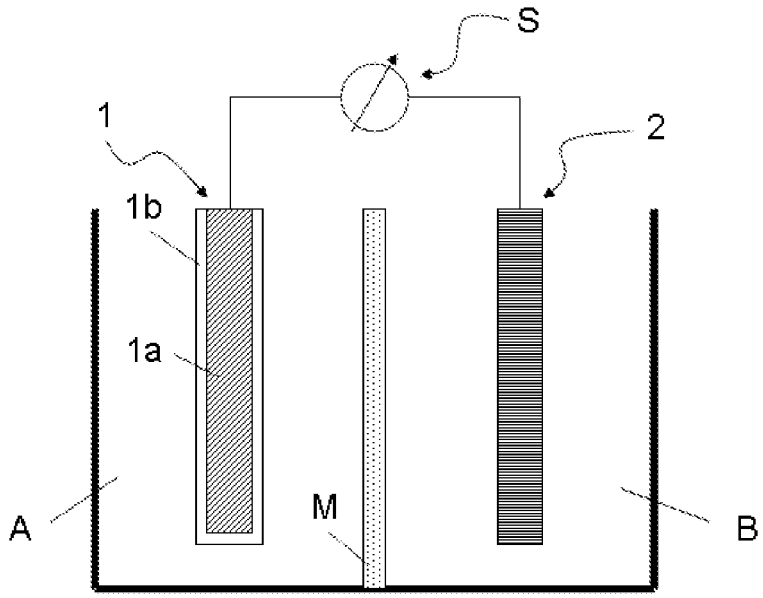
FIG. 1 depicts an electrochemical cell according to the invention.

FIG. 1 depicts an electrochemical cell according to the invention. It comprises a cathode (1) and an anode (2) which are electrically conductively connected to one another via an electric current and potential supply (S). The electrode chambers (A and B) are separated by a membrane (M) (Nafion®). An aqueous hydrochloric acid solution containing 2% by weight of HCl, which is permanently saturated with $O_2$, is present in the cathode chamber A, while an aqueous hydrogen chloride solution containing 20% by weight of HCl is present in the anode chamber (B).

Around the copper core (1*a*) of the cathode (1) there is a layer (1*b*) composed of a mixture of 1 g of Nafion® per 4 g of nitrogen-doped carbon nanotubes (NCNTs) at a total loading of 9.8 g/$m^2$ of the NCNTs. The layer is produced by spraying and drying of a 5% strength solution of Nafion® in isopropanol in which the NCNTs are dispersed. Finally, an NCNT-free solution of Nafion® in isopropanol is sprayed on and dried. This gives a loading of 8.0 g/$m^2$ of Nafion®. The nitrogen-doped carbon nanotubes have a nitrogen content of 4.28% by weight. The nitrogen-doped carbon nanotubes are produced as described in Text Example 5 of the hitherto unpublished German patent application number DE 10 2007 062 421.4.

The anode (2) comprises porous graphite.

Example 2

Further Development of the Electrochemical Cell

Figure 2:
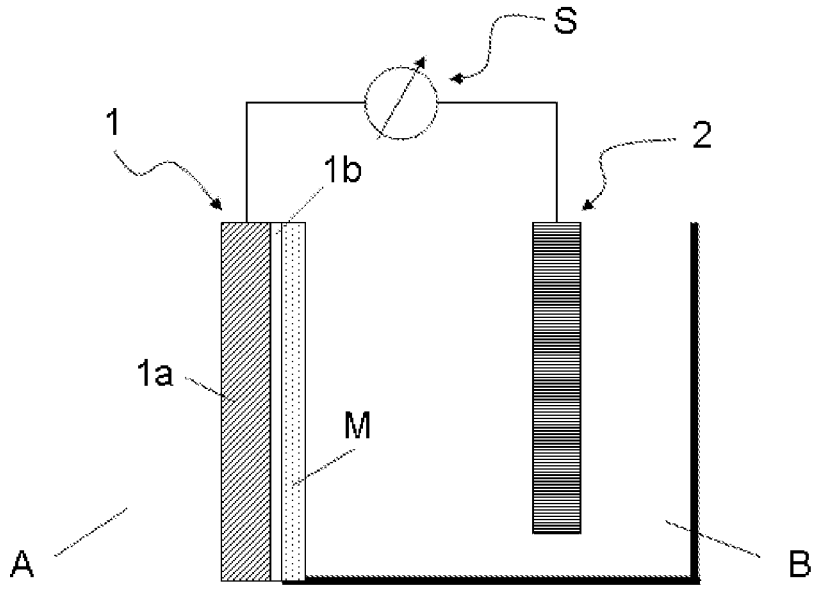
FIG. 2 depicts a preferred further development of the electrochemical cell of the invention.

In FIG. 2, the membrane (M) (Nafion®) is, according to a preferred further development of the invention, applied directly to the layer (1*b*) of the cathode. The layer (1*b*) comprises Nafion® as binder and a proportion of nitrogen-doped carbon nanotubes. The nitrogen-doped carbon nanotubes have a nitrogen content of 4.28% by weight. The cathode chamber (A) is open to the environment and accordingly filled with ambient air. All further properties of the apparatus as per FIG. 2 in this example correspond to those of Example 1, as illustrated above by FIG. 1.

Example 3

Preferred Further Development of the Electrochemical Cell

Figure 3:
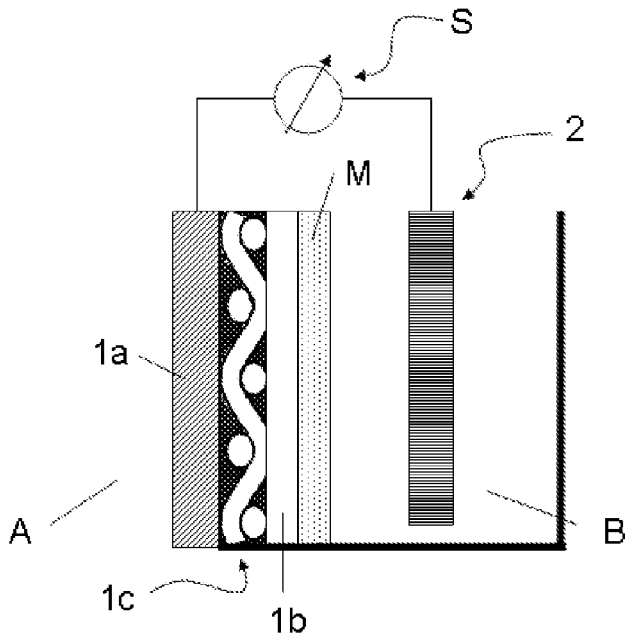
FIG. 3 depicts a particularly preferred further development of the electrochemical cell of the invention.

FIG. 3 shows a cathode which has the structure described in Example 2 and has been supplemented by a further layer (1*c*) (gas diffusion layer). Two cathodes having different NCNT loadings of 9.8 g/$m^2$ and 14.7 g/$m^2$, respectively, were used. The further layer comprises a woven fabric composed of graphitic carbon (from Ballard) to both sides of which an ink comprising acetylene black (Shawinigan Black; from CPChem) and PTFE has been applied a number of times by means of a gravure roller coating process. After each application of ink, the coating was dried and at the end the total layer (1*c*) was calcined at 340° C. The anode (2) comprises a titanium-palladium alloy (TiPd0.2) in the form of expanded metal coated with ruthenium-titanium mixed metal oxide.

Furthermore, the cathode chamber (A) is configured so that gas can be introduced into the back chamber of the cathode and the gas together with any reaction products obtained in liquid form can be discharged at the bottom of the cell.

Example 4

HCl Electrolysis in an Apparatus According to the Invention

Figure 4:
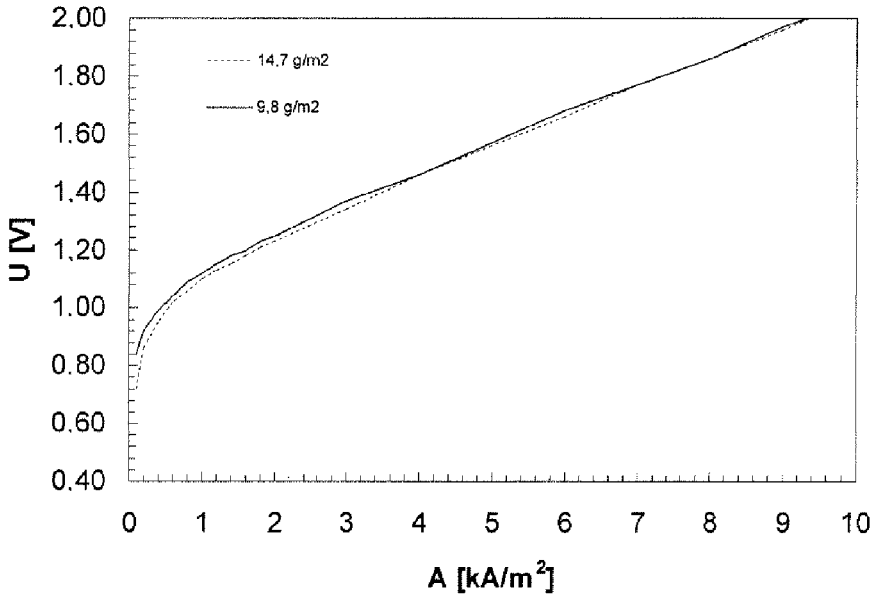
In FIG. 4, the cell potential (U) is shown as a function of the current density (A) in the preparation of chlorine from hydrogen chloride in the cell of the invention (cf.
Figure 5:
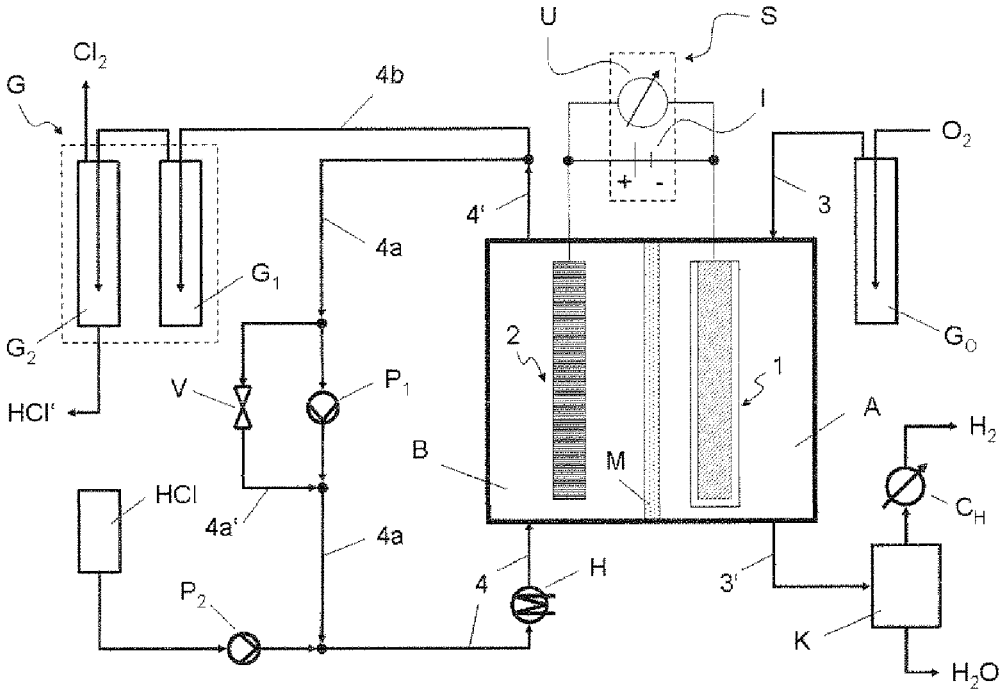
FIG. 5 shows a measurement arrangement as was used in Example 4 for the electrolysis according to the invention of HCl. This measurement arrangement comprises an electrochemical cell according to the invention having a cathode (1), an anode (2) and the associated electrode chambers (A, B) which are separated from one another by an ion-conducting membrane (M). The cathode (1) and the anode (2) are electrically conductively connected to a power supply (S) which comprises a current source (I) and a voltage source with display (U) connected in parallel.

FIG. 4 shows the cell potential as a function of the current density in the preparation of chlorine from hydrogen chloride in the cell of the invention (see FIG. 3, Example 3).

The liquid-filled gap between the surface of the anode (2) and membrane (M) was 2.5 mm. The active electrode area of anode and cathode was in each case 100 $cm^2$ and the membrane used was of the Flemion® 133 type. Oxygen (>99%) was introduced in a 3-fold stoichiometric excess (based on a current density of 5 $kA/m^2$) into the cathode chamber at a pressure of 0-10 mbar above ambient pressure and discharged at the bottom together with the water formed at the cathode as condensate. The purity of the gaseous oxygen stream discharged was monitored by means of a hydrogen sensor (sensitive at concentrations of 5 ppm of hydrogen upwards). 14% strength technical-grade hydrochloric acid was fed into the anode chamber (B). The electrolyte solution in the anode chamber (B) was circulated by pumping by means of a circulation pump and hydrochloric acid consumed in the electrolysis was replaced by introducing 30% strength technical-grade hydrochloric acid so that the hydrochloric acid concentration in the anode chamber was kept constant at 14% (+/−1%). The temperature of cell and electrolyte was kept constant at 60° C. The chlorine formed in the anode chamber was brought to a gauge pressure of 200 mbar relative to the cathode chamber by means of a liquid column.

The layers (1*b*) and (1*c*) of the cathode do not contain any noble metal. While chlorine is formed at the anode (2), reduction of oxygen occurs at the noble metal-free cathode. No hydrogen was detected in the stream of oxygen discharged from the cell over the entire measurement range up to current densities of 9 $kA/m^2$. The preparation of chlorine was carried out over a time of 4 days of operation at a current density of 5 $kA/m^2$ at a cell potential of 1.57 V without an increase in the cell potential necessary being found.

The invention claimed is:

1. Apparatus for the electrolysis of hydrochloric acid having an HCl concentration in the range from 10 to 25% by weight, having an electrode chamber (A) having a cathode (1) and a further electrode chamber (B) having an anode (2), with electrode chamber (A) and electrode chamber (B) being separated by an ion-conducting membrane (M) and the cathode and anode (1 and 2) being electrically conductively connected to a power supply (S), wherein the cathode (1) has an electrically conductive core (1*a*) on which a layer (1*b*), having a thickness of 30 μm to 1 mm comprising a polytetrafluoroethylene (PTFE) binder and nitrogen-doped carbon nanotubes and, optionally, a further layer (1*c*) between core (1*a*) and layer (1*b*), with the nitrogen-doped carbon nanotubes having functional groups containing nitrogen.

2. Apparatus according to claim 1, wherein electrode chamber (A) is provided with a feed line (3) for an aqueous electrolyte solution containing oxygen gas or for air or oxygen-containing gases.

3. Apparatus according to claim 1, wherein the electrode chamber (B) is provided with a feed line (4) for hydrochloric acid or a gas containing hydrogen chloride.

4. Apparatus according to claim 1, wherein the carbon nanotubes doped with nitrogen-containing groups are produced by the following process:

a. precipitation of at least one metal (M) from a solution of a metal salt (MS) of the at least one metal (M) in a solvent (L) to give a solids suspension (S) containing metals (M), b. separation of the solid (F) from the suspension (S) and if appropriate after-treatment of the solid (F) to give a metal catalyst (K), c. introduction of the metal catalyst (K) into a fluidized bed, d. reaction of at least one nitrogen-containing carbon compound as starting material (E1), or of at least two starting materials (E2, E2'), where at least one starting material comprises a carbon compound and at least one starting material comprises a nitrogen compound, in the fluidized bed over the metal catalyst (K) at a temperature of at least 300° C., in the presence of hydrogen gas or hydrogen-containing compounds to form nitrogen-doped carbon nanotubes (NCNTs), e. discharge of the nitrogen-doped carbon nanotubes (NCNTs) from the fluidized bed.

5. Apparatus according to claim 4, wherein the catalyst is based on manganese, cobalt, $Al_2O_3$ and MgO, where Mn is present in a proportion by mass of from 2 to 65% and Co is present in a proportion by mass of from 2 to 80%, $Al_2O_3$ is present in a proportion by mass of from 5 to 75% and MgO is present in a proportion by mass of from 5 to 70%.

6. Apparatus according to claim 1, wherein the core (1*a*) of the cathode (1) is present in the form of an electrically conductive gauze, mesh, nonwoven fabric or woven fabric.

7. Apparatus according to claim 1, wherein the cathode (1) is electrically connected to a current distributor made up of one or more materials selected from the group consisting of copper, graphite, titanium, titanium alloy containing noble metal, in particular TiPd, and the Ni alloys Hastelloy® and Incolloy®.

8. Apparatus according to claim 1, wherein the layer (1*b*) comprises a proportion of at least 10% by weight of nitrogen-doped carbon nanotubes.

9. Apparatus according to claim 1, wherein the nitrogen-doped carbon nanotubes have a proportion of nitrogen of at least 1% by weight.

10. Apparatus according to claim 1, wherein the thickness of the layer (1*b*) is not more than 200 μm.

11. Apparatus according to claim 1, wherein the ion-conducting membrane (M) is a polymer membrane.

12. Apparatus according to claim 11, wherein the polymer membrane is based on polymeric perfluorosulfonic acids.

13. Apparatus according to claim 1, wherein the ion-conducting membrane (M) and the layer (1*b*) of the electrode (1) are in direct contact.

14. Apparatus according to claim 1, wherein a further layer (1*c*) is present between the core (1*a*) and the layer (1*b*).

15. Apparatus according to claim 14, wherein the further layer (1*c*) comprises at least one electrically conductive material and a hydrophobic material.

16. A method for the electrolysis of hydrogen chloride which comprises carrying out said electrolysis in the apparatus of claim 1.

17. Apparatus of claim 15, wherein said electrically conductive material is graphite and said hydrophobic material is PTFE.

* * * * *